United States Patent [19]

Magadini

[11] Patent Number: 4,940,247

[45] Date of Patent: Jul. 10, 1990

[54] BAT WITH REVERSE CONICAL GRIP

[75] Inventor: John A. Magadini, Phoenixville, Pa.

[73] Assignee: Ten Pro Corporation, Phoenixville, Pa.

[21] Appl. No.: 327,319

[22] Filed: Mar. 22, 1989

[51] Int. Cl.[5] ..... A63B 59/06

[52] U.S. Cl. ..... 273/72 A; 373/72 R

[58] Field of Search ..... 273/72, 67 R, 81 B, 273/62 DA, 26 B

[56] References Cited

U.S. PATENT DOCUMENTS

| | | | |
|---|---|---|---|
| 729,639 | 6/1903 | McCoy | 273/72 R |
| 796,184 | 8/1905 | Brown | 273/72 R |
| 1,018,866 | 2/1912 | Blahos | 273/72 R |
| 2,031,161 | 2/1936 | Hamel | 273/72 R |
| 2,775,455 | 12/1956 | Liberti | 273/72 R |
| 4,248,425 | 2/1981 | Easton et al. | 273/72 A |
| 4,836,541 | 6/1989 | Henley | 273/72 R |

FOREIGN PATENT DOCUMENTS

| | | | |
|---|---|---|---|
| 9232 | of 1913 | United Kingdom | 273/81 B |

*Primary Examiner*—Edward M. Coven
*Assistant Examiner*—M. Graham
*Attorney, Agent, or Firm*—Eckert Seamans Cherin & Mellott

[57] ABSTRACT

A hollow metallic baseball bat is disclosed which includes a large diameter impact section, a small diameter gripping section and a transition section therebetween. The lower end of the small diameter gripping section is configured to provide a reverse conical grip whereby the smaller two fingers of the lower hand of the batter can more tightly grip the bat. In modifications of the reverse conical grip, the lower end of the gripping section can be formed of modified oval configuration or modified elliptical configuration to more comfortably tightly receive the lower hand of the batter.

6 Claims, 1 Drawing Sheet

BAT WITH REVERSE CONICAL GRIP

BACKGROUND OF THE INVENTION

1. Field of the Invention

This invention relates generally to the field of metallic baseball bat constructions, and more particularly, is directed to a hollow metal bat incorporating a special grip section designed to enhance the strength of the batter's grip when the bat is in use.

2. Description of the Prior Art

It has been known to provide hollow metallic baseball bat structures having various configurations and composed of a wide range of materials. In general, most popular metallic baseball bat bodies have been formed of aluminum tube stock which has been worked, such as by swaging, to provide a relatively small diameter handle portion, a relatively large diameter impact or barrel portion and a tapered portion intermediate the handle portion and the impact portion to form a smooth transition section therebetween. Usually, metal or rubber end caps have been affixed to the large and small diameter end portions to close the opposed open ends of the baseball bat body.

U.S. Pat. No. 4,744,136 to Foreman, et al discloses a softball or baseball bat of metallic construction having a small diameter, closed handle section which is joined to an enlarged striking or impact section by an intermediate transition zone. The end of the striking section is closed by a weighted end plug.

In U.S. Pat. No. 3,479,030 to Merola, another hollow, metallic baseball or softball bat is disclosed having a uniform diameter gripping section, a striking or impact section with a smooth transition zone therebetween. The end of the striking section is closed with a resilient plug.

In U.S. Pat. No. 3,727,295 to Gildmeister, a hollow metallic bat is shown having a uniform, small diameter gripping section, a ball striking section with a transition zone therebetween. The hollow interior of the bat is foam filled to more closely simulate the feel of a wooden bat.

In U.S. Pat. No. 4,241,914, Foreman discloses an aluminum softball or baseball bat comprising a uniform diameter, smaller gripping section, a larger ball striking section with a transition zone therebetween and having a rubber plug at the extreme end of the striking portion whereby the ambient pressure interior of the bat can be varied to specifically control vibration characteristics when the bat strikes the ball.

In U.S. Pat. No. 3,703,290, Wilson shows a baseball bat construction featuring a uniform diameter handle portion, a larger barrel or impact portion with a tapered portion therebetween. The end of the barrel portion is closed with a separate plug element and the end of the grip portion is closed with a suitable knob.

So far as is known to the present applicant, all of the prior art metallic bat constructions disclose gripping portions which were essentially hollow cylindrical in configuration, having the same diameter throughout the length of the gripping portion.

SUMMARY OF THE INVENTION

The baseball or softball bat of the present invention is formed of a hollow metallic tube stock, preferably aluminum tube stock. The tube stock is swaged down in known manner to form a handle or grip portion, a barrel or impact portion and a transition zone therebetween to smoothly transform from the smaller diameter portion to the larger diameter portion. The handle or grip portion is further configured near its lower end to provide a truncated, reverse conical grip area to comfortably receive the smaller two fingers of the lower hand of the user in a manner to inherently provide more strength, safety, power and bat speed when the bat is in use.

In accordance with usual industry practice, metallic baseball and softball bats as presently constructed feature a small diameter handle or grip portion that is hollow, cylindrical in configuration and is generally between approximately ten inches and sixteen inches in length. The bat construction of the present invention will seem conventional in all respects as to appearance, general configuration and manufacturing technique, with the exception that the lower two inches or so of the handle portion will be tapered endwardly in the form of a truncated conical configuration. Optionally, the handle or grip portion could be otherwise formed at the lower end to anatomically fit the bottom hand of the batter as it grips the bat to thereby increase the strength and power of the batter's grip. Perhaps a wide oval or a modified elliptical cross sectional configuration could be employed.

In accordance with the preferred embodiment of the invention, the handle or grip portion will be swaged down to a uniform diameter as is generally the present standard in the metallic baseball bat industry. Approximately two inches from the lower end of the gripping portion, in order to accommodate the lower or smaller two fingers of the lower hand of the user, the gripping portion will be further swaged to a final or smallest diameter. Preferably, the transition from the larger diameter portion of the handle or grip to the smaller diameter will be in the form of a truncated, gentle conical configuration. Alternately, the lower end of the gripping portion could be in the configuration of a wide oval or elliptical shape as most convenient and comfortable for the lower hand of the batter to thereby enhance the strength of the grip of the batter's lower hand as it grasps the bat. While the dimensions set forth are considered optimum for use in the metallic bat industry, it will be appreciated that the dimensions stated should not be limiting in any effect and the general concept of reducing or otherwise altering the diameter of the baseball or softball bat handle or grip portion at the lower hand area thereof remains the main element of the present invention.

It is therefore an object of the present invention to provide an improved bat with reverse conical grip of the type set forth.

It is another object of the present invention to provide a novel bat with reverse conical grip comprising a larger barrel or impact portion, a smaller handle or grip portion and a transition zone therebetween wherein the lower end of the handle or grip portion is formed of reduced diameter to increase grip strength and to provide more power when the bat is in use.

It is another object of the present invention to provide a metallic bat with a configured grip portion wherein the handle or grip portion is formed of generally hollow, cylindrical construction except at the lower end wherein the exterior periphery of the grip portion is altered at the lower hand grip area to provide a construction enabling increased grip strength and power when the bat is in use.

It is another object of the present invention to provide a novel bat with reverse conical grip that is inexpensive in manufacture, simple in design and which can provide increased power when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

DESCRIPTION OF THE PREFERRED EMBODIMENTS OF THE INVENTION

Figure 1:
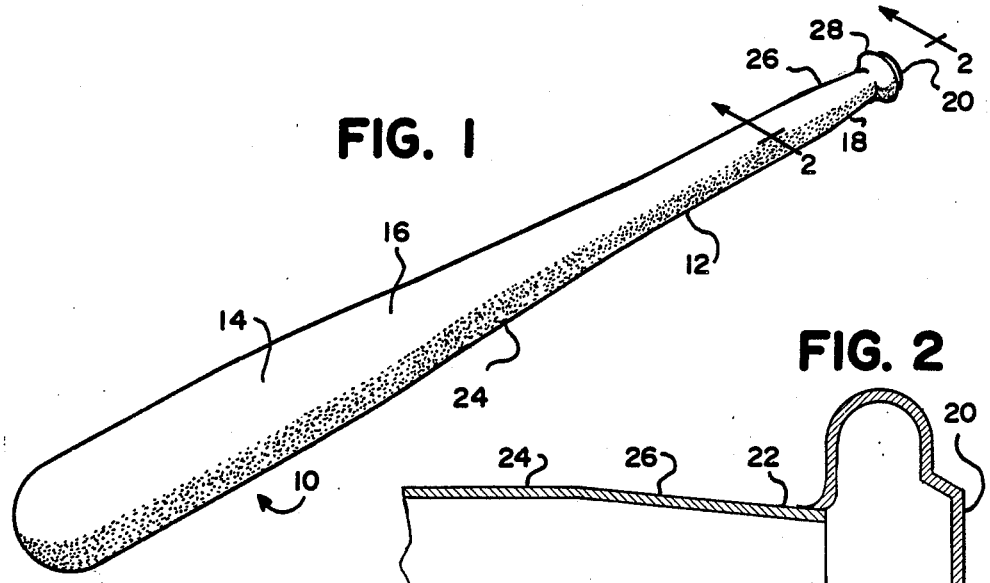
FIG. 1 is a perspective view of a metallic baseball or softball bat construction showing the new grip configuration of the present invention.

Although specific terms are used in a the following description for the sake of clarity, these terms are intended to refer only to the particular structure of the invention selected for illustration in the drawings, and are not intended to define or limit the scope of the invention.

Referring now to the drawings, there is shown in FIG. 1 a softball or baseball bat 10 which preferably is fabricated of metallic construction, such as unitary hollow aluminum tubing. The bat 10 in general appearance is externally similar to the existing prior art bats used in baseball and softball games and comprises a small diameter handle or grip portion 12 which is adapted to be grasped by the user (not shown). The bat 10 further comprises an enlarged barrel or impact portion 14 and a transition zone or tapered portion 16 therebetween in a well known manner. The handle or grip portion 12 terminates endwardly in an enlarged, metallic knob 20, which knob can be affixed to the handle portion by welding or other suitable metal treatment in a known, secure manner. The enlarged knob 20 defines the lower end of the bat and is employed to prevent the bat 10 from slipping from the grip of the user upon swinging at a ball. Preferably, when in use, the handle or grip portion 12 is covered in conventional manner by a rubberized sleeve or tape to further enhance the grip of the user upon the bat 10.

Figure 2:
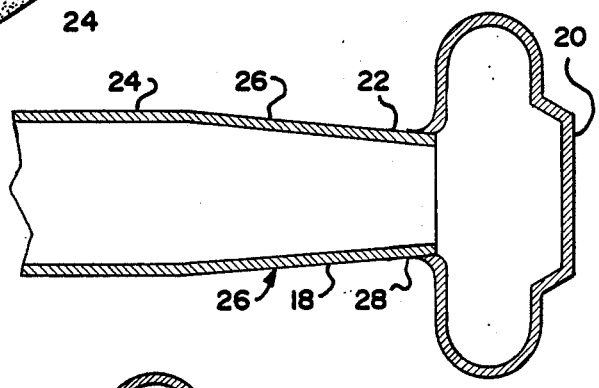
FIG. 2 is an enlarged, partial, cross sectional view taken along line 2—2 on FIG. 1, looking in the direction of the arrows.

Still referring to FIG. 1, and as best seen in FIG. 2, the handle or grip portion 12 is upwardly formed with a uniform diameter section 24 which extends from the lower end of the transition zone 16 to near the lower end 22 of the bat grip portion 12. An enhanced gripping zone or area 26 is formed between the lower end 22 of the handle or grip portion and the lower end of the uniform diameter section 24. As illustrated, the enhanced gripping zone 26 is configured in the shape of a truncated cone wherein the conical configuration tapers gently downwardly toward the lower bat end 22. The enhanced gripping zone 26 can be formed approximately one and one half inches to two inches in length to correspond essentially to the width of the lower two fingers of the lower hand of the batter (not shown). The enhanced gripping zone 26 can taper downwardly from a diameter of approximately one inch at the top of the zone to a diameter of approximately three quarters of an inch at the bottom of the zone, thereby providing an end area 28 of minimum diameter to enable the lower or smallest two fingers of the batter's lower hand to more tightly grip the bat in a manner to provide greater strength, safety, power and bat speed. By fabricating the lower end of the enhanced gripping zone 26 of smallest diameter, the small finger (not shown) of the batter's lower hand can more completely encircle the handle or grip portion 12 than heretofore was possible with bat grip portions of uniform diameter or of outwardly flared diameter as was occasionally heretofore employed.

Figure 3:
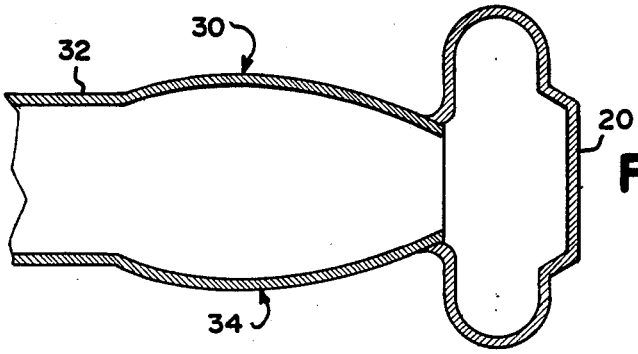
FIG. 3 is an enlarged, partial, cross sectional view similar to FIG. 2 showing a second embodiment of a lower handle configuration.

Referring now to FIG. 3, there is illustrated a modified handle or grip portion 30 having a larger, uniform diameter section 32 similar in diameter and length to the uniform section 24 and a smaller, configured enhanced gripping zone 34 of the length considerably shorter than the uniform diameter section 32. As illustrated, the enhanced gripping zone 34 is not uniform in diameter, but rather, is configured to a wide modified oval or generally elliptical cross section configuration of shape designed to anatomically fit the lower hand of the batter as the lower hand grips the bat. By carefully forming the modified, enhanced gripping zone 34 to naturally fit the contours of the lower hand of the user as he grips the bat, the batter will be given greater confidence in his swing and will be able to grasp the bat with increased strength, safety and power than would otherwise be possible with conventional bats having completely cylindrical handle or grip portions of uniform diameter. As illustrated, the lower end of the enhanced gripping zone is preferably smaller in diameter than the upper end.

Figure 4:
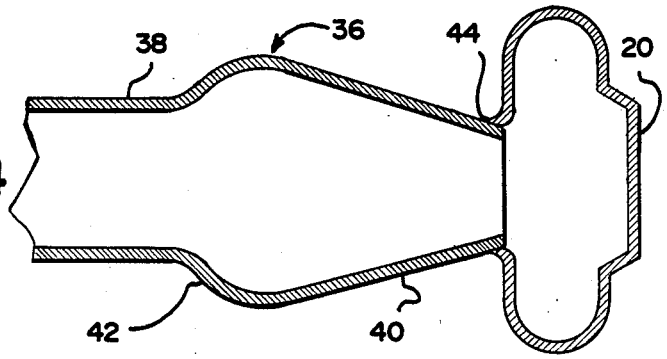
FIG. 4 is an enlarged, partial, cross sectional view similar to FIG. 2 showing a third embodiment of a lower handle configuration.

In FIG. 4, there is illustrated a second modified handle or grip portion 36 which comprises a conventional, upper, uniform diameter section 38 and a lower, shorter, modified elliptical cross section enhanced gripping zone 40. The modified enhanced gripping zone 40 illustrated in FIG. 4 is preferably fabricated to a generally modified elliptical cross sectional configuration having one end portion 44 of lesser diameter and one end portion 42 of greater diameter to thereby enhance the strength of the batter's lower hand grip as the lower hand grasps the enhanced gripping zone 40.

Accordingly, by fabricating the handle or grip portion 12 of a metallic softball or baseball bat 10 of non-uniform diameter, particularly at its lower end 22, more of the strength and energy of the batter (not shown) can be imparted to the bat through the lower two fingers of the batter's lower hand, or through the batter's lower hand, thereby inherently providing greater strength to the grip and more power to the impact as the bat is swung and strikes the ball.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. A hollow metallic baseball bat comprising:

a bat body having a generally cylindrical, upper, impact portion of a first, large diameter, a generally cylindrical, lower, handle portion of a second, smaller diameter and a transition zone intermediate the impact portion and the handle portion, the impact portion terminating upwardly in a closed end and the handle portion terminating downwardly in an enlarged knob, the knob having a diameter greater than the diameter of the handle portion; and the handle portion being subdivided into an upper area adjacent to the transition zone, the upper area having uniform diameter and a lower area adjacent to the knob, the lower area having non-uniform diameter, the lower area of non-uniform diameter having an upper, large diameter section and a lower, small diameter section, the lower, small diameter section terminating downwardly at the said knob and the upper, large diameter section of the lower area terminating upwardly at the said handle portion uniform diameter upper area.

2. The baseball bat of claim 1 wherein the lower area is shaped in longitudinal cross section in a truncated conical configuration.

3. The baseball bat of claim 1 wherein the lower area is shaped in a longitudinal cross section in a modified oval cross sectional configuration.

4. The baseball bat of claim 1 wherein the lower area is shaped in longitudinal cross section in a modified elliptical cross sectional configuration.

5. The baseball bat of claim 1 wherein the upper area of the handle portion is longer than the said lower area of the handle portion.

6. The baseball bat of claim 1 wherein the ratio of length of the said lower, non-uniform diameter area of the handle portion to the length of the upper, uniform diameter area of the handle portion is at least two to ten.

* * * * *